US005429677A

United States Patent [19]

Brown

[11] Patent Number: 5,429,677

[45] Date of Patent: Jul. 4, 1995

[54] ADJUSTABLE ELEMENT FOR PROTECTING ADJACENT SURFACES WHILE PAINTING

[76] Inventor: David M. Brown, 217 Oak St., Newport, N.H. 03773

[21] Appl. No.: 243,302

[22] Filed: May 16, 1994

[51] Int. Cl.[6] ..... B05C 17/00

[52] U.S. Cl. ..... 118/504; 15/257.01; 118/505

[58] Field of Search ..... 118/504, 505, 213, 301, 118/406; 427/272, 282; 52/DIG. 1; 15/257.01; 451/457

[56] References Cited

U.S. PATENT DOCUMENTS 1,411,462 4/1922 Wendt ..... 15/257.01
1,491,693 4/1924 Graham ..... 15/257.01
4,620,503 11/1986 Pullens ..... 118/505
5,192,602 3/1993 Spencer et al. ..... 118/505

*Primary Examiner*—W. Gary Jones
*Assistant Examiner*—Laura E. Edwards
*Attorney, Agent, or Firm*—Stephen W. White

[57] ABSTRACT

A device for adjustably providing protection to adjacent surfaces while painting is described. This device comprises a height adjustable handle connected to a masking element by an articulating hinged element. The masking element comprises a flat, rectangular guide with a series of movable fins held to one of the longer edges thereof, by a pair of opposable gripping elements. These fins can be moved and adjusted to fit in and around a clap board sided building, for example. Thus, when the device is placed on the clap board siding, the fins fit perfectly to this siding and any adjacent edge will be protected by the masking element during the painting cycle.

5 Claims, 2 Drawing Sheets

FIG. 2
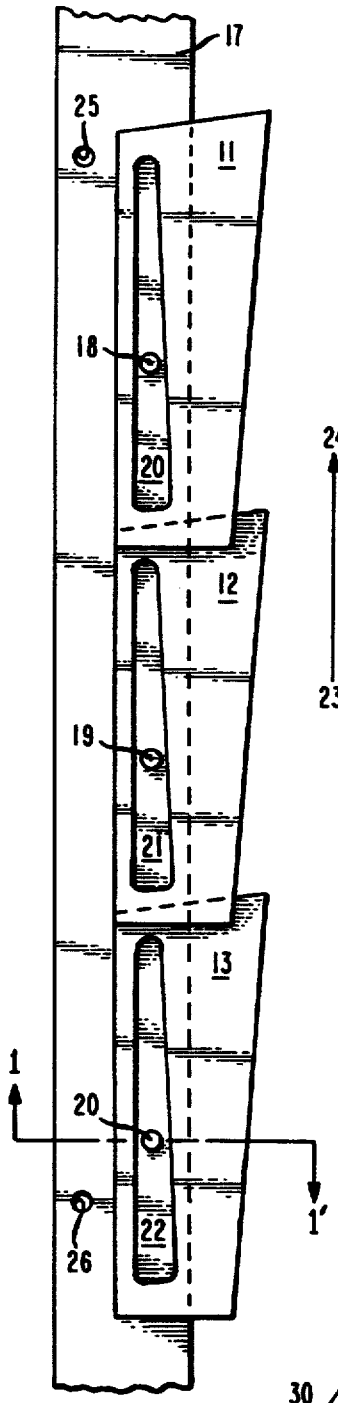
FIG. 3
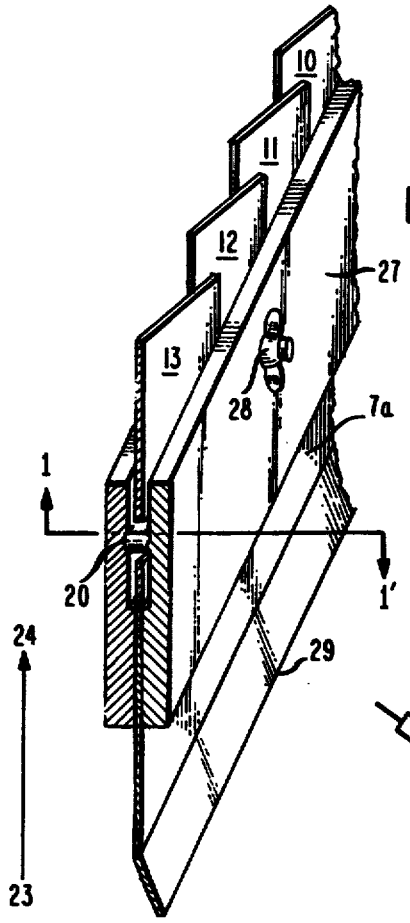
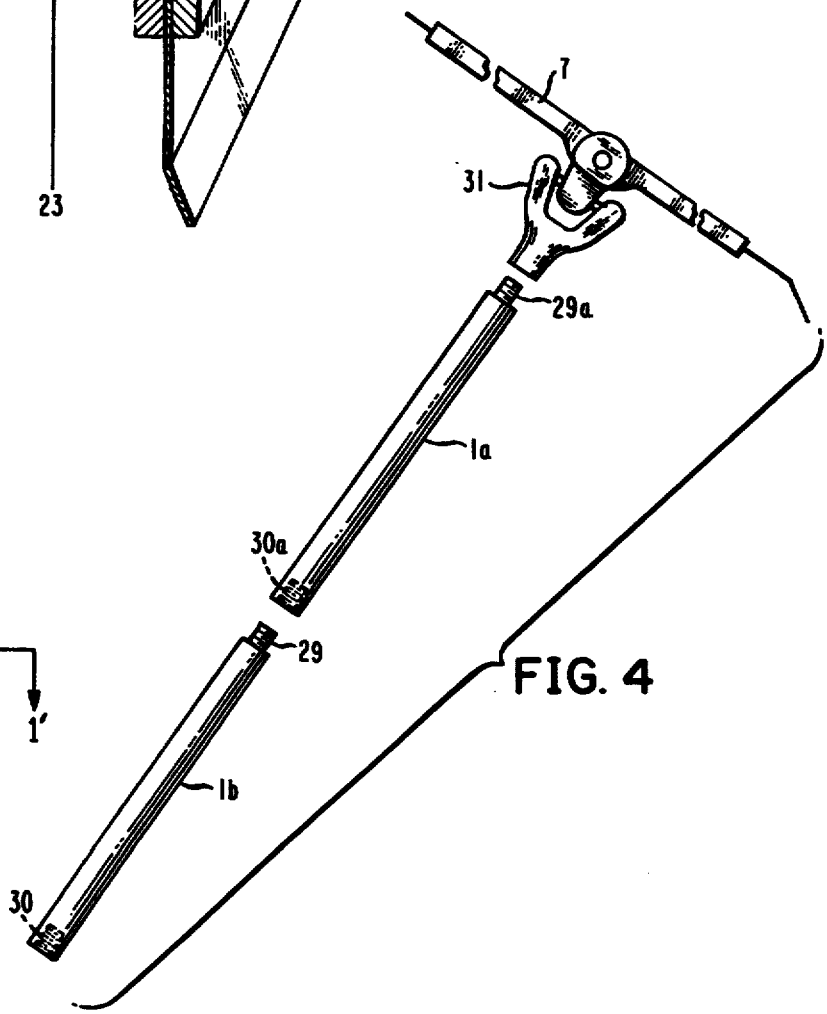
FIG. 4

ADJUSTABLE ELEMENT FOR PROTECTING ADJACENT SURFACES WHILE PAINTING

BACKGROUND OF THE INVENTION

1. Field of the Invention

This invention relates to the field of painting and more specifically to a device that can be used to adjustably protect an edge while painting. Still more specifically, this invention relates to an adjustable device that is particularly useful in protecting trim and the like while painting a house that is sided with clapboard or similar un even or novelty siding.

2. Description of the Prior Art

There are a host of elements that are used to protect edging, trim and the like while paint is being applied to an adjacent area. By paint, I mean all of the conventional materials that can be applied to a variety of surfaces in order to beautify or protect some those surfaces. These materials include paints such as water-based or oil-based paints; protective oils and solvents that are applied to protect surfaces against aging; stains and the like, among others. Protecting adjacent areas during the application of a paint is particularly needed when a paint is applied by a paint sprayer, for example. These paint applying elements tend to cover areas adjacent to that for which the paint is being applied. In these cases, for example, it is conventional to use some kind of tape to "mask" the area which is to be protected while painting. This is truly a cumbersome and time consuming step and involves a great deal of labor. Most of these elements are cumbersome and difficult to use and reuse. Other elements that are used to protect adjacent areas to those being painted include metal strips which can be held on a straight line by either the painter or the helper. Alternatively, simple pieces of cardboard may be used and then discarded after use.

While painting a ceiling or other high place, it is known to use an element which comprises a flat, protective shield held in the middle thereof by an articulating means on a pole or rod. While the ceiling is being painted, a helper holds this device against the edge where the wall meets the ceiling thus protecting the wall from paint being applied to the ceiling in that particular area. As the painter moves from area to area, the helper moves this portable device to protect each adjacent area from the un-wanted application of paint thereon.

Most of the prior art elements are useful in masking or protecting adjacent areas during the painting process if those areas are essentially straight, level or separable therefrom. While painting the side of houses which are sided with conventional clap board or other uneven novelty type siding, it is extremely difficult to paint this siding while trying to protect the adjacent areas around windows and doorways, for example. Since the clapboard surface is uneven as compared to window and door trims, conventional elements such as that described above, cannot be used since they do not conform to the clapboard surface. Thus, most painters must tediously mask each adjacent area taking care to conform the masking tape around that clapboard surface. This is very time consuming and often results in an uneven paint job since the masking can be applied unevenly. Thus, there is a pressing need for an element that can be used to adjustably protect adjacent surfaces while applying paint thereto.

SUMMARY OF THE INVENTION

It is an object of this invention: to provide an element that can be used to adjustably protect adjacent surfaces while painting. It is another object of this invention to provide an adjustable protective element that can be used when painting clapboard siding. These and yet other objects are achieved in an element for adjustably protecting adjacent surfaces during painting wherein said element has a height adjustable handle articulatingly hinged to a masking element, said masking element comprising a flat, rectangular guide, said guide having a length and a width, a pair of opposing short edges and a pair of opposing long edges, and a pair of opposing gripping elements located along the length of one of said long edges, wherein one of said gripping elements has a series of pins located perpendicularly therein along the length thereof and a plurality of slanted fins each of said fins having a variable holes cut therein, said fin elements fitting between said gripping elements and being connected thereto by fitting said variable holes over said pins, and wherein said gripping element is attached to said flat, rectangular guide by a series of detachable fastening elements.

BRIEF DESCRIPTION OF THE DRAWINGS

FIG. 2 is a cut away detailed side showing of the fins attached by the variable holes to pins on one of the gripping elements.

FIG. 3 is a cut away detailed end showing of the of the gripping elements containing fins and attached to the flat, rectangular guide element.

FIG. 4 is a detailed showing of the adjustable pole articulatingly attached to the rectangular guide element.

DETAILS OF THE INVENTION

Figure 1:
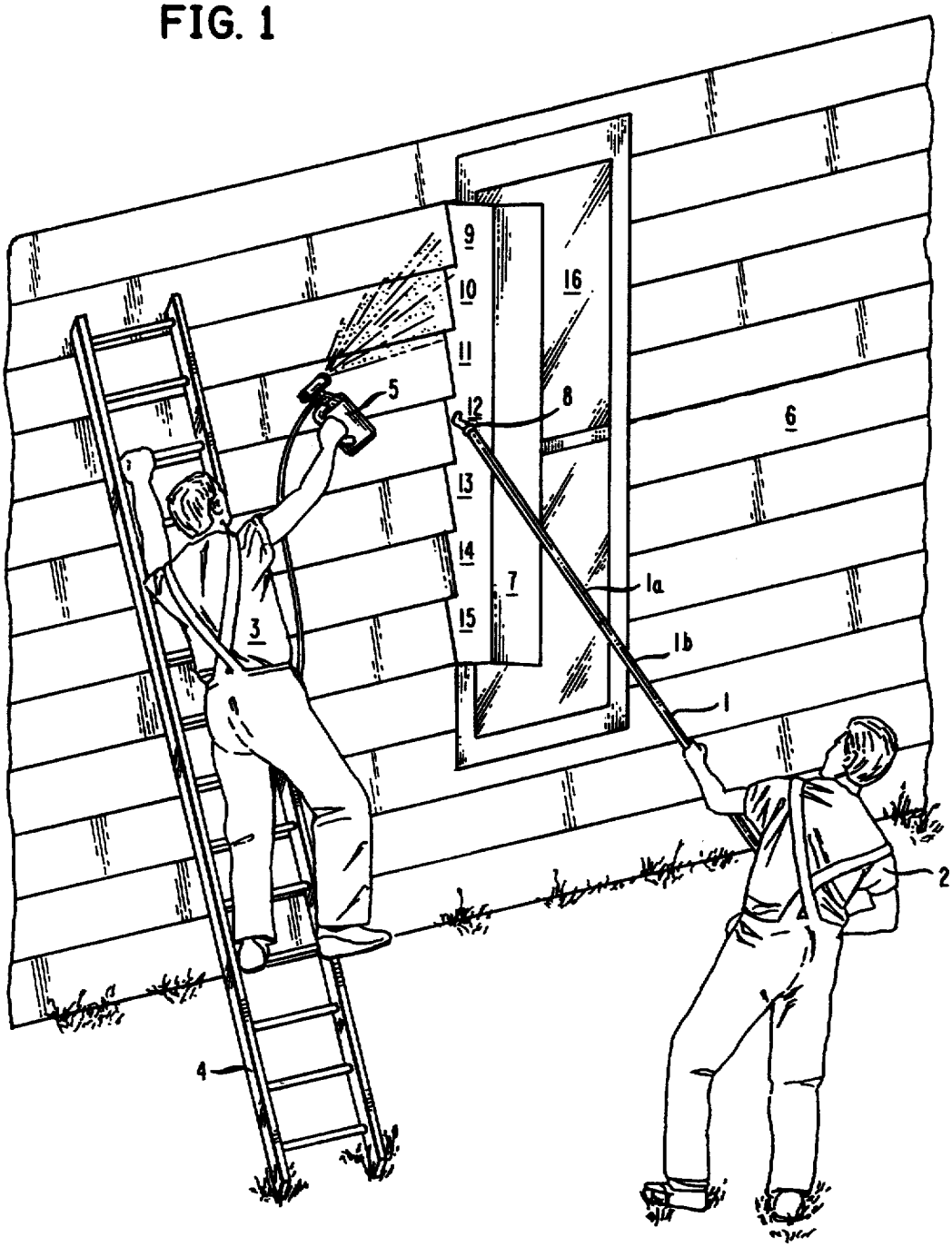
FIG. 1 shows of the device of this invention being employed during the spray painting of a clap board sided building.

Looking now specifically at the drawings, FIG. 1 is a showing of the device of this invention I being held by a helper 2 while a painter 3 standing on a ladder 4 applies paint by using a sprayer 5 on the clap board siding of a building 6. The device 1 is shown in a particularly preferred mode in this figure while being used in a particularly preferred instance, e.g. while painting a clap board sided building. In this figure, the device 1 has an adjustable pole or handle which is shown in two, connectable,sections 1*a* and 1*b*. Other lengths may be added to this handle to increase the length thereof. Or, to decrease the length, one of the sections may be removed, if required. In yet another embodiment, the handle may be of the telescoping variety in order to achieve the desired length. This embodiment is not shown in the drawings accompanying this specification. The helper holds on to one end of the handle and places the masking element 7 in the desired area. In this particular figure, the area to be masked is the window. The handle 1 is articulatingly hinged to the masking element 7 at point 8. The details of the articulating hinge are not shown in this figure. A plurality of adjustable, slanted fins, shown as 9 through 15, are fitted to a rectangular guide (*7a*) along one of a pair of opposing long edges. The details of the means for this fitting are not shown in this figure. Each of these fins has been adjusted so as to fit in and around and thereby fully cover the clap board siding that is being painted. Since the clap board siding abuts the window 16, as shown in this drawing, it is imperative to insure that none of the paint or stain being applied to the clap board reaches the window and trim. As shown in this figure, the device of this invention will fully provide that protection.

FIG. 2 is a cut away showing of one of the gripping elements 11 which contains a series of pins 18 through 19. Fins 11, 12 and 13, respectively, are attached to these pins through variable holes 20, 21 and 22. In this particular showing, these holes are tapered slots. Thus, when the fins are moved up or down on the pins, the angle of each fin can be variably adjusted. For example, an upward motion along the line 23–24, will push the fins out more increasing the angle, as the variable holes each are smaller in that direction. The reverse is true for the reverse motion. A pair of holes 25 and 26 are shown here. These holes are used as a means for firmly attaching the opposing gripping elements to the rectangular guide of the masking element.

FIG. 3 is a cut away showing along the lines 1—1" through pin 20 of FIG. 2. In this showing opposing gripping element 11 and pin 20 are holding fin 13 in place. The other opposing gripping element 27 insures the firm containment thereof via a bolt and wing nut 28 which has been passed through hole 26, not seen in this figure. The opposing long edge 29 of the masking element 7, may also be used as a straight edged mask along a straight line, for example.

FIG. 4 is a detailed showing of the connection of two of the handle elements **1*a* and 1*b*. As shown in this figure, these can be mated or connected by threading. In this particular showing, one end of each of pole elements 1*a* and 1*b* contains a male threaded element 29 and 29*a* whilst the other end of each of these poles contains a matching female threaded element 30 and 30*a*. The handle elements are not shown connected in this figure for a better view thereof. As can be seen, the articulating hinge element 31 is attached to the masking element 7. Other details of the masking element 7** are not shown in this figure. The articulating hinge element as illustrated in this drawing is a pair of rotating pins interconnected so that the handle can be moved, in respect to the masking element, in any direction desired. This greatly facilitates the utility of the device of this invention since handle, masking element and fins are adjustable to the particular job envisioned by the painters.

The adjustable element of this invention that is useful for protecting adjacent surfaces while painting may be made from any number of conventional materials. For example, the height adjustable pole may be fashioned from wood, various plastics or aluminum while the flat, rectangular guide or masking element may be made from heavy duty cardboard, plastics, aluminum or wood. Aluminum is particularly preferred since it is a very stable and elements made therefrom are easy to clean and store. It is also preferred that the fins be made from aluminum for the same reasons. The articulating hinged element that is connected between the rectangular guide is also conventional, being well-known in this industry. As stated previously, the articulating hinged element may be connected to the adjustable pole by screwing a threaded end into a threaded receptacle, for example.

The element of this invention is most useful when painting a building in which the siding is of the clap board type. Here, the painting of the clap boards themselves is difficult to do with a common brush and it is most convenient to use a spray device to apply the paint on the surface. When using this device, the paint gets into all of the uneven surfaces formed by the clap boards and the protection of the surface is maximized. However, it is well known that a spray device is not as accurate as a brush in applying the paint to the desired surface. Thus, the areas surrounding the areas to be painted, must be masked. It is here that the device of this invention finds its' ultimate use. The user can adjust the width and angle of each fin to exactly match that of the clap board being painted. For example, the user would loosen all of the fastening means holding the opposing gripping elements in place (e.g. wing nuts) thus loosening the fins. A simple push of the device up against the particular clap board siding to be painted, will exactly match the angle and depth of the fins to that clap board siding. After re-tightening the fastening means, the device is ready to use for that particular application. The fins slide within the variable holes cut in the surface thereof and move in a direction which matches that of the clap board being painted. Then, the fins will match exactly that particular siding. In use, the device can be held by a helper against any surface that is not to be painted and the device will protect that surface from any unwanted paint. At the end of the painting cycle, the user simply washes off the paint in either solvent or water to clean the device for re-use on another job. If additional length is desired, additional pole elements can be added. The entire apparatus is easily dismantled for cleaning, adjusting and repair, if required.

The masking element can be made in a number of convenient lengths. I prefer an element that is between 10 inches to 48 inches in length and 3 inches to 12 inches in width, although these dimensions are not particularly important to the essence of this invention. One of normal skill in the art can make a paint spraying protection device of the size requisite to protect adjacent areas during said paint spraying. The fins themselves can be from 2 inches to 6 inches in length and should match the conventional size of commercially available clap board. The number of fins useful in this device will depend on the size of masking element used. In a particularly preferred element the masking element will be about 24 inches in length and 8 inches in width with about 8 fin elements contained thereon.

Since the device contains two, opposing long edges, and since only one of these edges contains fin elements, the other edge can be used as a straight edge for other painting purposes. Thus, the device of this invention has a two-fold use adding greatly to its' utility within the contract painting industry.

I claim:

1. A device for adjustably protecting adjacent surfaces during painting comprising a height adjustable handle articulatingly hinged to a masking element, said masking element comprising a flat, rectangular guide, said guide having a length and a width, a pair of opposing short edges and a pair of opposing long edges, and a pair of opposing gripping elements located along the length of one of said long edges, wherein one of said opposing gripping elements has a series of pins located perpendicularly therein along the length thereof and a plurality of slanted fins, each of said fins having a variable hole cut therein said fins fitting between said opposing gripping elements and being connected thereto by fitting each variable hole over a respective pin, and wherein said opposing gripping elements are attached to said flat, rectangular guide by a series of detachable fastening elements.

2. The device of claim 1 wherein said variable hole cut in each fin is a slot of variable width.

3. The device of claim 1 wherein said fastening elements for said opposing gripping elements are bolts and wing nuts.

4. The device of claim 1 wherein said masking element and said fins are made of aluminum and wherein said masking element is between 10 inches to 48 inches in length and 3 inches to 12 inches in width.

5. The device of claim 1 wherein said height adjustable handle is a wooden pole having several sections mated together.

* * * * *